US008196302B2

(12) United States Patent
Nording

(10) Patent No.: US 8,196,302 B2
(45) Date of Patent: Jun. 12, 2012

(54) METHOD OF MANUFACTURING AN AIR GAP INSULATED EXHAUST COLLECTOR MANIFOLD BY LOCATING MANIFOLD COMPONENTS INTO AN OUTER SHELL AND REDUCING A CROSS SECTION OF THE OUTER SHELL TO RETAIN THE MANIFOLD COMPONENTS

(75) Inventor: Thomas Nording, Esslingen (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 649 days.

(21) Appl. No.: 12/337,122

(22) Filed: Dec. 17, 2008

(65) Prior Publication Data

US 2009/0158588 A1 Jun. 25, 2009

(30) Foreign Application Priority Data

Dec. 24, 2007 (DE) ..... 10 2007 062 659

(51) Int. Cl.
*F16L 13/16* (2006.01)
*F16L 13/14* (2006.01)
*F16L 9/19* (2006.01)

(52) U.S. Cl. ..... 29/890.08; 29/445; 29/455.1; 29/505; 29/508; 123/65 EM

(58) Field of Classification Search ..... 29/890.08, 29/445, 455.1, 505, 234, 272, 282; 72/367.1, 72/368, 370.1, 370.12, 370.13; 123/65 EM
See application file for complete search history.

(56) References Cited

U.S. PATENT DOCUMENTS 4,179,884 A * 12/1979 Koeslin ..... 60/321
4,897,908 A * 2/1990 Henriksson ..... 29/890.044
5,018,272 A * 5/1991 Seeger et al. ..... 29/890.08
5,100,047 A * 3/1992 Nakagawa et al. ..... 228/176
5,170,557 A * 12/1992 Rigsby ..... 29/890.08
5,390,494 A * 2/1995 Clegg ..... 60/299
5,713,611 A * 2/1998 Kurimoto et al. ..... 285/382.5
5,768,890 A * 6/1998 Bekkering et al. ..... 60/305
5,784,882 A * 7/1998 Bonny et al. ..... 60/323
5,799,395 A * 9/1998 Nording et al. ..... 29/890.08
5,907,134 A * 5/1999 Nording et al. ..... 181/228

(Continued)

FOREIGN PATENT DOCUMENTS

DE 3216980 A1 11/1983

(Continued)

*Primary Examiner* — David Bryant
*Assistant Examiner* — Jason L Vaughan
(74) *Attorney, Agent, or Firm* — Reinhart Boerner Van Deuren P.C.

(57) ABSTRACT

The present invention relates to a method for manufacturing an air gap-insulated exhaust collector for an exhaust system of an internal combustion engine, in particular in a motor vehicle, wherein individual gas-conducting components of an inner shell body are inserted into one another in the region of at least one slide fit, wherein a calibrating process, in which a reduction in cross section takes place at least on the respective outer component, is carried out in the region of at least one slide fit of this type when the components are inserted into one another.

16 Claims, 2 Drawing Sheets

U.S. PATENT DOCUMENTS

| | | | | |
|---|---|---|---|---|
| 6,038,769 | A * | 3/2000 | Bonny et al. | 29/890.08 |
| 6,223,434 | B1 * | 5/2001 | Morikawa | 29/890.08 |
| 6,247,552 | B1 * | 6/2001 | Kovar et al. | 181/240 |
| 6,343,417 | B1 * | 2/2002 | Bonny et al. | 29/890.08 |
| 6,349,468 | B1 * | 2/2002 | Bonny et al. | 29/890.08 |
| 6,427,440 | B1 * | 8/2002 | Bonny et al. | 60/323 |
| 6,523,343 | B2 * | 2/2003 | Durr et al. | 60/323 |
| 6,555,070 | B1 * | 4/2003 | Kruger | 422/179 |
| 6,604,358 | B2 * | 8/2003 | Durr et al. | 60/323 |
| 6,654,995 | B1 * | 12/2003 | Wang et al. | 29/421.1 |
| 6,702,062 | B2 | 3/2004 | Kusabiraki et al. | |
| 6,708,488 | B2 * | 3/2004 | Buter | 60/323 |
| 6,725,656 | B2 * | 4/2004 | Moore et al. | 60/323 |
| 7,127,816 | B2 * | 10/2006 | Kiehl | 29/897.2 |
| 7,252,177 | B2 | 8/2007 | Minato | |
| 7,272,927 | B2 * | 9/2007 | Geminn et al. | 60/323 |
| 7,434,390 | B2 * | 10/2008 | Nording et al. | 60/323 |
| 2002/0174650 | A1 | 11/2002 | Durr et al. | |
| 2004/0099242 | A1 | 5/2004 | Wu et al. | |
| 2005/0072143 | A1 | 4/2005 | Diez | |
| 2005/0086936 | A1 | 4/2005 | Bucknell et al. | |
| 2005/0115231 | A1 | 6/2005 | Ashida et al. | |
| 2005/0183414 | A1 | 8/2005 | Bien et al. | |
| 2009/0158724 | A1 | 6/2009 | Muller | |

FOREIGN PATENT DOCUMENTS

| | | | | |
|---|---|---|---|---|
| DE | 44 37 380 | A1 | | 7/1995 |
| DE | 10112707 | C1 | | 6/2002 |
| DE | 102005002250 | A1 | | 7/2006 |
| EP | 0 695 901 | B1 | | 2/1996 |
| EP | 0695901 | A1 | * | 2/1996 |
| EP | 0 919 703 | B1 | | 6/1999 |
| EP | 0 928 885 | A2 | | 7/1999 |
| EP | 0 992 659 | A2 | | 4/2000 |
| EP | 1225314 | A2 | | 7/2002 |
| EP | 1291500 | A2 | | 3/2003 |
| EP | 0 664 385 | B1 | | 4/2003 |
| EP | 1 522 687 | A3 | | 4/2005 |
| JP | 63215809 | A | * | 9/1988 |
| JP | 02055823 | A | | 2/1990 |

* cited by examiner

METHOD OF MANUFACTURING AN AIR GAP INSULATED EXHAUST COLLECTOR MANIFOLD BY LOCATING MANIFOLD COMPONENTS INTO AN OUTER SHELL AND REDUCING A CROSS SECTION OF THE OUTER SHELL TO RETAIN THE MANIFOLD COMPONENTS

CROSS-REFERENCE TO RELATED PATENT APPLICATIONS

This patent application claims the benefit of co-pending German Patent Application No. DE 102007062659.4, filed Dec. 24, 2007, the entire teachings and disclosure of which are incorporated herein by reference thereto.

FIELD OF THE INVENTION

The present invention relates to a method for manufacturing an air gap-insulated exhaust collector for an exhaust system of an internal combustion engine, in particular in a motor vehicle. The invention also relates to an air gap-insulated exhaust collector manufactured using the method.

BACKGROUND OF THE INVENTION

An exhaust collector or else exhaust manifold combines the exhaust gases from a plurality of cylinders of an internal combustion engine. In the case of an air gap-insulated exhaust collector, at least one inner shell body, which is provided to conduct exhaust gases, is sheathed by an outer shell body so as to form a thermally insulating air gap. The use of air gap-insulated exhaust collectors allows the thermal loading of an engine unit or a cylinder head, onto which the exhaust collector is flanged, to be reduced.

In order to increase the power of an internal combustion engine, it is generally known to charge the fresh gas supplied to the combustion chambers with the aid of an exhaust turbocharger. For this purpose, the respective exhaust turbocharger can be connected on the exhaust gas side directly to the exhaust collector. The exhaust gas has at this point its highest temperature and its highest pressure, as a result of which very high enthalpy is available for the exhaust turbocharger. Modern turbochargers can operate in accordance with the twin-scroll principle. On the one hand, a twin-scroll exhaust turbocharger of this type has two separate inlet paths which lead from the common exhaust gas-side inlet to the common turbine of the turbocharger. On the other hand, the cylinders, which supply the turbocharger with exhaust gas, of the internal combustion engine are divided into two groups in order to separately supply their exhaust gases to one of the inlet paths of the twin-scroll turbocharger. This allows exhaust gas to be applied more uniformly to the turbine even at lower speeds of the internal combustion engine; this improves the response characteristics of the turbocharger, in particular shifts said characteristics toward lower speeds. The separate conducting of exhaust gas from the individual cylinder groups can take place via separate exhaust collectors. In the case of an air gap-insulated exhaust collector, this can also be achieved as a result of the fact that two separate inner shell bodies, which are each associated with one cylinder group, are arranged in the common outer shell body.

In particular in the case of air gap-insulated exhaust collectors, it is conventional to assemble the respective inner shell body from a plurality of individual gas-conducting components. For this purpose, the individual gas-conducting components are inserted into one another in the region of at least one slide fit. The design with slide fits reduces thermally induced stresses within the exhaust collector.

Manufacturing tolerances must be taken into account in the manufacture of the individual components of the inner shell bodies. This inevitably leads to engagement of the respective components within the respective slide fit with greater or lesser radial play. However, during operation of the exhaust collector, radial play of this type leads to leakage. As the outer shell body surrounds the respective inner shell body in a gas-tight manner, such leakages are usually uncritical. However, for the use of the exhaust collector in conjunction with a twin-scroll exhaust turbocharger, there is the need to reduce the leakages in the region of the slide fit, in particular when two inner shell bodies are arranged in a common outer shell body.

BRIEF SUMMARY OF THE INVENTION

Embodiments of the present invention address the problem of disclosing for an exhaust collector or for an associated manufacturing method an improved embodiment which is in particular distinguished in that the exhaust collector is particularly suitable for operation with a twin-scroll exhaust turbocharger. Leakages in the region of the slide fits are in particular to be reduced.

Embodiments of the invention are based on the general idea of carrying out a calibrating process in the respective slide fit. This imparts a predefined geometry to at least the outer component in the respective slide fit by reshaping. In particular, a predetermined, comparatively narrow radial play may be set in this way in the respective slide fit. Equally, the calibrating can be carried out in such a way that the two components abut each other without play in the slide fit. For this purpose, provision may be made to reduce at least the respective outer component, by purposeful reshaping with regard to its cross section, until it enters into abutment against the respective inner component in the slide fit. In other words, when the components are inserted into one another in the respective slide fit, the outer component is reduced to the inner component by reshaping. The reduction in cross section is in this case carried out in such a way that the slide fit function is still ensured. Ease of movement of the slide fit is immaterial in this regard, as the thermally induced relative movements between the individual components, which are mounted on one another in the slide fit, are generated by relatively large stresses or forces, so that in principle a comparatively stiff slide fit is sufficient to avoid inadmissible high stresses in the structure of the exhaust collector.

The calibrating can in particular be carried out in such a way that, within the respective slide fit, the respective outer component touches, after the reduction in cross section, the respective inner component in the circumferential direction at at least three points which are set apart from one another. This means that the two components are radially secured to each other. The three touching points or contact points, which are set apart from one another in the circumferential direction, can for example be formed by three discrete contact points which are set apart from one another in the circumferential direction. Equally, at least one discrete contact point can be combined with at least one segment-shaped contact point allowing contacting along a circumferential segment. Equally, two or more segment-shaped contact points of this type may be sufficient. Contacting which is closed in the circumferential direction, i.e. continuous, is also conceivable. The individual contact points can in this case be point-by-point or linear or planar.

As the gas-conducting components almost abut one another in the slide fit, after the respective reduction in cross section of the outer component, an increased sealing effect can be attained in the slide fit. It will be clear that the contacting does not necessarily have to be planar, as this is possible merely in an ideal case. Radial securing of the components, which are inserted into one another, is also attained simply when radial supporting takes place in the circumferential direction at at least three contact points which are set apart from one another. Remaining radial gaps are small compared to their axial length in the slide fit, thus providing a throttle effect which acts like a seal, known as the throttle sealing gap. Insofar as two inner shell bodies, the slide fits of which have been calibrated as proposed in the invention, are arranged in a common outer shell body, only a small amount of gas can now issue from one of the inner shell bodies into the outer shell body and pass therefrom into the respective other inner shell body. The markedly reduced or markedly damped leakage in the region of the slide fits allows in particular compensation of pressure between the separate gas paths within the inner shell bodies to be avoided, thus increasing the efficiency of the twin-scroll turbocharger.

Further important features and advantages of embodiments of the invention will emerge from the claims, from the drawings and from the associated description of the figures given with reference to the drawings.

It will be understood that the features mentioned hereinbefore and those to be described hereinafter can be used not only in the respectively specified combination, but rather also in other combinations or in isolation, without departing from the scope of the present invention.

Other aspects, objectives and advantages of the invention will become more apparent from the following detailed description when taken in conjunction with the accompanying drawings.

BRIEF DESCRIPTION OF THE DRAWINGS

Preferred exemplary embodiments of the invention are illustrated in the drawings and will be described in greater detail in the subsequent description, the same or similar or functionally equivalent components being provided with the same reference numerals. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
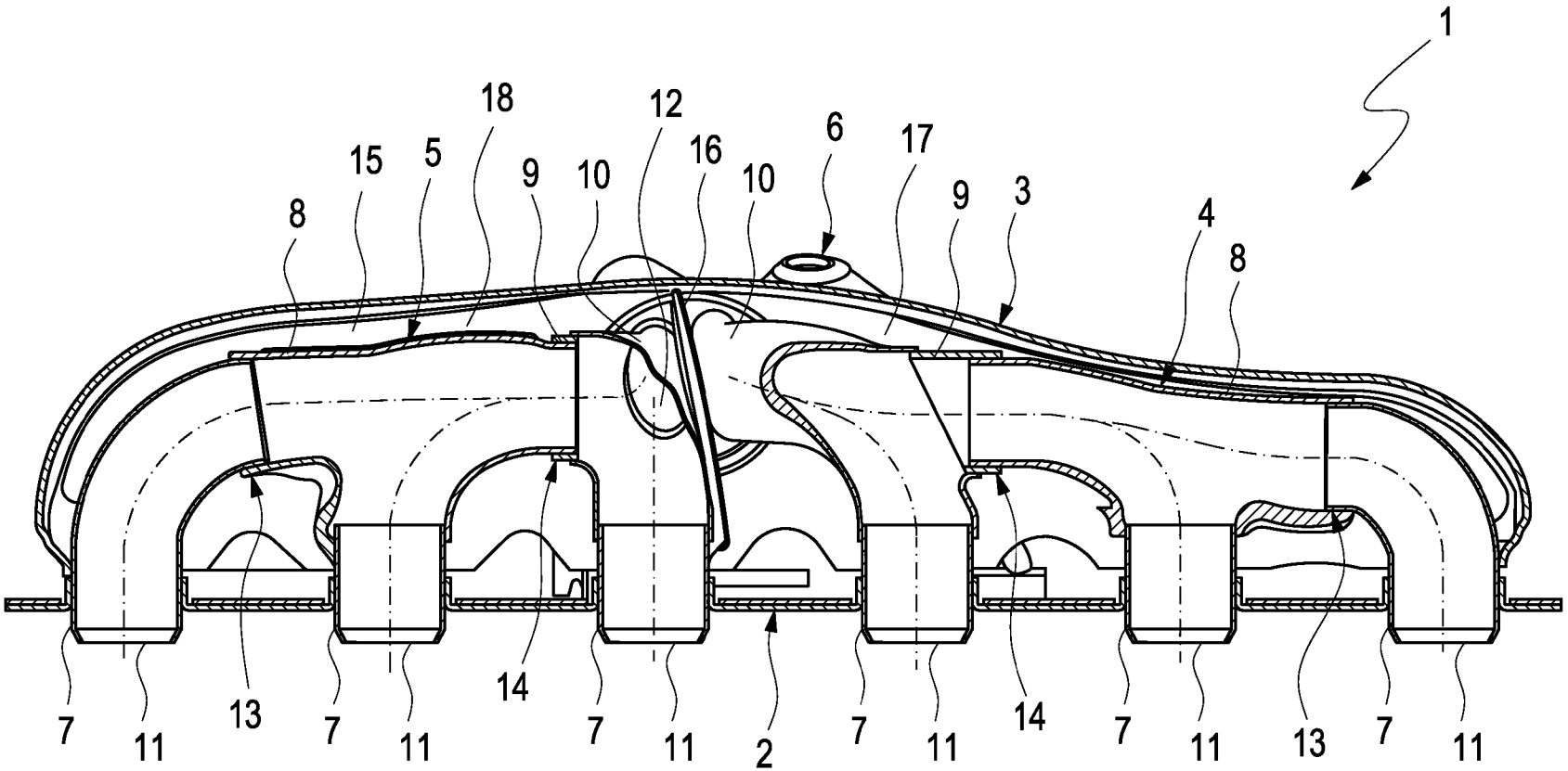
FIG. 1 is a schematic longitudinal section through an exhaust collector.

As shown in FIG. 1, an air gap-insulated exhaust collector 1 has a flange 2, an outer shell body 3 and at least one inner shell body 4, 5. In the example, the exhaust collector 1 has two inner shell bodies 4, 5. The exhaust collector 1 forms as a whole an input region of an exhaust system (otherwise not shown) of an internal combustion engine which can in particular be arranged in a motor vehicle. Preferably, in the case of a charged internal combustion engine, an exhaust turbocharger 6 (indicated in this case by a broken line) is connected directly to the exhaust collector 1. Said exhaust turbocharger is in particular a twin-scroll exhaust turbocharger 6 which is distinguished by two separate inlet paths which lead from an exhaust gas-side inlet of the turbocharger 6 to a turbine or to a turbine wheel of the turbocharger 6.

The outer shell body 3 sheaths in this case the two inner shell bodies 4, 5 which are set apart from each other so as to form a thermally insulating air gap between the skin of the outer shell body 3 and the respective skin of the respective inner shell body 4, 5.

The two inner shell bodies 4, 5 are each assembled from a plurality of individual, gas-conducting components. In the example shown, each inner shell body 4, 5 has three inlet pipes 7, a connecting pipe 8, a coupling pipe 9 and an outlet pipe 10. The inlet pipes 7 each have an inlet opening 11 which, when the exhaust collector 1 is assembled, are each associated with one cylinder of the internal combustion engine. The connecting pipe 8 connects the two first inlet pipes 7 to the outlet pipe 10 via the coupling pipe 9. The outlet pipe 10 then connects the connecting pipe 8 and the third inlet pipe 7 to an outlet opening 12 of the respective inner shell body 4, 5. In the assembled state, the respective outlet opening 12 can now lead to one of the two inlet paths of the twin-scroll turbocharger 6.

In the example shown, the respective inner shell body 4, 5 has in each case two slide fits 13 and 14 respectively. The first slide fit 13 is in this case formed between the first inlet pipe 7 and the connecting pipe 8, while the second slide fit 14 is formed between the connecting pipe 8 and the coupling pipe 9. The respective slide fit 13, 14 allows axial displacement between the components which are inserted into one another. The axial direction is in this case defined by the axial direction of the respective slide fit 13, 14 and thus by the insertion direction in which, in the respective slide fit 13, 14, the two components are inserted into each other. In the first slide fit 13, the connecting pipe 8 is the outer component, while the first inlet pipe 7 is the inner component. In contrast thereto, in the case of the second slide fit 14, the coupling pipe 9 is the outer component, while the connecting pipe 8 forms the inner component.

During manufacture of the respective inner shell body 4, 5, the individual components 7, 8, 9, 10 are first inserted into one another in the region of the slide fits 13, 14. Subsequently, a calibrating process, in which a reduction in cross section takes place at least on the respective outer component, is carried out at least in one of the slide fits 13, 14, preferably in both slide fits 13, 14. This calibrating process can in this case purposefully be carried out so as to subsequently form in the slide fit a predetermined, comparatively narrow radial gap between the two components which are inserted into each other. The gap width of this radial gap can in particular be smaller than the wall thickness of the respective inner component and/or of the respective outer component in the respective slide fit 13, 14. Preference is given to an embodiment in which the gap width is smaller than 50% or even smaller than 20% of the wall thickness of the outer and/or inner component. After the calibrating process, the gap width is in any case significantly smaller than in the case of the conventional design if the separately manufactured components are inserted into one another owing to comparatively high manufacturing tolerances in the respective slide fit 13, 14. Equally, the calibrating can be carried out in such a way that subsequently the respective outer component enters into abutment against the respective inner component. The reduction in cross section required for this purpose can in this case take place in such a way that subsequently the outer component touches the respective inner component in the region of the respective slide fit 13, 14 at at least three points which are set apart from one another in the circumferential direction. Ideally, the contact between the components, which are inserted into one another, within the respective slide fit 13, 14 is continuous in the circumferential direction, in particular planar. What is important in this regard is that the reduction in cross section is carried out in components which are inserted into one another, so that it is possible to calibrate the respective outer component to the cross section of the respective inner component.

The calibrating can in particular be carried out in such a way that the two components are subsequently inserted into each other without play in the slide fit 13, 14. Additionally or optionally, the calibrating can also be carried out in such a way as to form a radial press fit in the respective slide fit 13, 14. The radial compression is in this case purposefully attained in such a way that the press fit allows thermally induced axial relative movements which can be required between the components which are mounted on one another through the slide fit 13, 14.

The calibration with a reduction in cross section can be carried out for example with the aid of a reshaping die having two half-shells which are lowered one onto the other. This reshaping can be carried out particularly inexpensively. In particular, once the individual components have been joined together, the respective inner shell body 4, 5 can be inserted into one of the half-shells of the reshaping die. The other half-shell is then lowered, as a result of which the reshaping is carried out for the purposes of calibration. Particularly advantageous in this regard is an embodiment in which, in the same reshaping die, two or more slide fits 13, 14 can at the same time be reshaped within the same inner shell body 4, 5 with regard to a reduction in cross section. Accordingly, only one operation is then required in order to calibrate all slide fits 13, 14 in accordance with the invention. In the case of one development, provision may also be made to arrange the two inner shell bodies 4, 5 of the exhaust collector 1 in the same reshaping die in order to simultaneously calibrate in one reshaping step the respective slide fits 13, 14 of the two inner shell bodies 4, 5.

The reductions in cross section of the respective outer components in the respective slide fit 13, 14 can in principle be carried out in such a way as to basically allow also for a reduction in cross section of the respective inner component. However, in this case it is necessary to ensure that subsequently the resulting press fit or the ensuing slide fit 13, 14 can still perform its function as the slide fit 13, 14 under the thermal loads occurring during operation of the exhaust collector 1. As mentioned hereinbefore, a stiff press fit 13, 14 is in this case comparatively uncritical, as sufficiently high forces occur during operation.

Figure 2A:
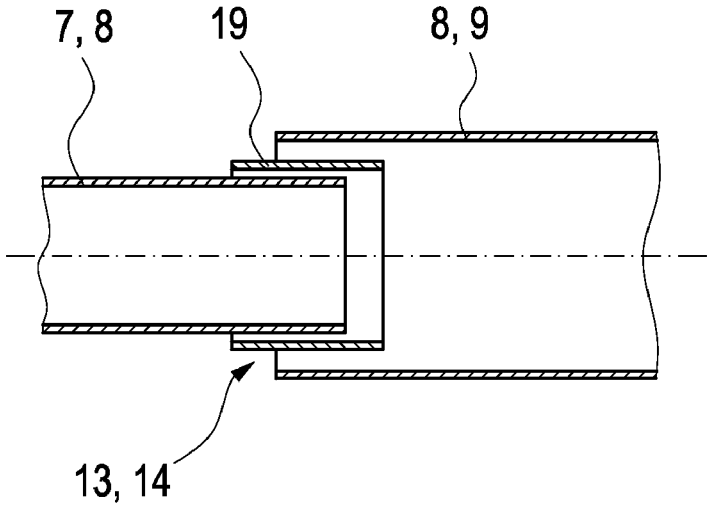
FIG. 2 is a schematic longitudinal section through the exhaust collector in the region of a slide fit during different manufacturing phases a, b and c.
Figure 2B:
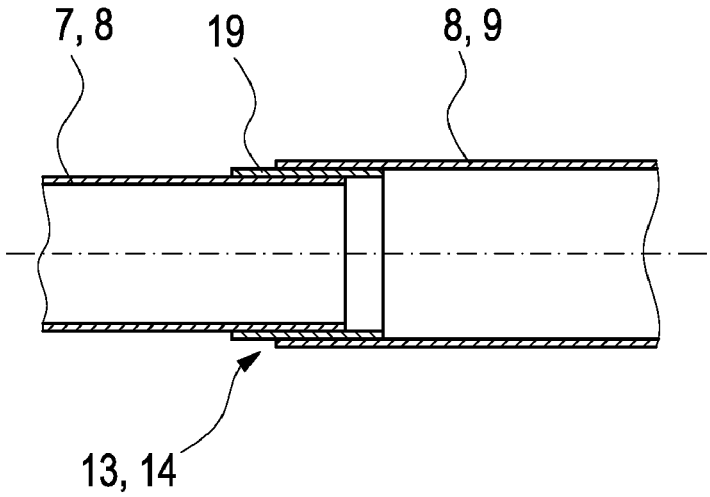
Figure 2C:
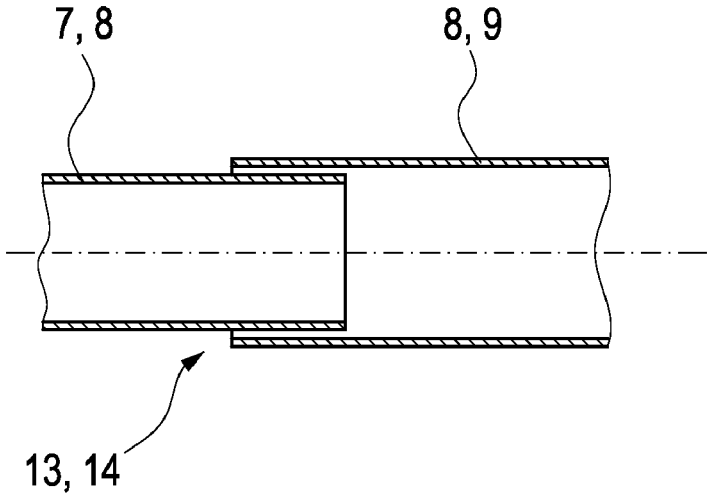

As shown in FIG. 2*a* to 2*c*, in the case of a particular embodiment, provision may be made for a spacer sleeve 19 to be arranged, during assembly of the inner shell bodies 4, 5 in the slide fit 13, 14 subsequently to be calibrated, radially between the respective inner component 7 or 8 and the outer component 8 or 9, cf. FIG. 2*a*. During the calibrating process, this spacer sleeve 19 ensures that the reshaping process does not bring the two components 7 and 8 or 8 and 9, which are inserted into each other, into contact with each other. During reshaping, the outer component 8 or 9 is thus supported on the inner component 7 or 8 via the spacer sleeve 19, wherein at the same time reshaping can in principle also be carried out on the inner component 7 or 8. The use of a spacer sleeve 19 of this type allows the formation, in the respective slide fit 13 or 14 as a result of the calibration, of a defined radial gap which can in the first place be tightly closed by the spacer sleeve 19, cf. FIG. 2*b*. Expediently, the spacer sleeve 19 is therefore made of a material, for example of a plastics material, which is volatile at the temperatures which are conventional during operation of the exhaust collector 1. In particular, the spacer sleeve 19 is fully incinerable. After the volatilization of the spacer sleeve 19, the respective slide fit 13 or 14 has the desired defined, i.e. calibrated, radial play which—as mentioned hereinbefore—can be much less than in the case of the conventional design without a calibrating process, cf. FIG. 2*c*. FIG. 2*a* shows the components 7 and 8 or 8 and 9 with the spacer sleeve 19 inserted before the calibrating. FIG. 2*b* shows the components 7 and 8 or 8 and 9 with the spacer sleeve 19 after the calibrating and FIG. 2*c* shows the calibrated slide fit 13 or 14 after the removal of the spacer sleeve 19.

In the example shown, the inlet pipes 7 are connected, in particular welded, to the flange 2. The outer shell body 3 is connected securely, in particular welded, to the inner shell bodies 4, 5 in the region of the inlet pipes 7. Linking to the flange 2 is in this case not provided for the outer shell body 3, although it may be carried out in the case of a different embodiment. The shell body 3 sheaths a receiving space 15 in which both inner shell bodies 3, 4 are accommodated. Merely the inlet pipes 7 protrude from the outer shell body 3. In the example, a partition 16, which divides the receiving space 15 into two partial spaces 17 and 18 in each of which one of the inner shell bodies 4, 5 is arranged, is arranged in the outer shell body 3. The partition 16 can separate the two partial spaces 17, 18 from each other, in particular in a gas-tight or almost gas-tight manner, thus allowing compensation of pressure between the two partial spaces 17, 18 to be impeded.

The calibrated slide fits 13, 14 are distinguished by reduced leakage, thus impeding compensation of pressure between the exhaust gas flows within the two inner shell bodies 4, 5. In addition, the partition 16 can cause a further contribution to preventing compensation of pressure between the two gas paths. Furthermore, the separate connection of the two inner shell bodies 4, 5, via their separated outlet openings 12, to the two separate inlet paths of the turbocharger 6 causes further independent and separate conduction of gas to the turbocharger 6. This allows the twin-scroll turbocharger 6 to be operated particularly effectively.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for manufacturing an air gap-insulated exhaust collector for an exhaust system of an internal combustion engine, in particular in a motor vehicle comprising:

inserting individual gas-conducting components of a first inner shell body into one another in the region of at least one slide fit; performing a calibrating process, including reducing a cross section at least on the respective outer component, which is carried out in the region of at least one slide fit of this type when the components are inserted into one another;

locating the gas-conducting components of the first inner shell body within a receiving space of an outer shell body forming a thermally insulating air gap between the gas-conducting components and the outer shell body;

inserting individual gas-conducting components of a second inner shell body into one another in the region of at least one slide fit; performing a calibrating process, including reducing a cross section at least on the respective outer component of the second inner shell body, which is carried out in the region of at least one slide fit of this type when the components are inserted into one another;

locating the first and second inner shell bodies within the receiving space;

adding a partition within the receiving space separating the receiving space into first and second partial spaces; and locating the first inner shell body within the first partial space and locating the second inner shell body within the second partial space.

2. The method of claim 1, wherein the calibrating process is carried out in such a way that the respective components are subsequently inserted into one another without play in the slide fit.

3. The method of claim 1, wherein the calibrating process is carried out in such a way as to form in the respective slide fit a radial press fit which allows thermally induced axial relative movements between the components which are mounted on one another via the respective slide fit.

4. The method of claim 1, wherein the calibrating process is carried out in such a way as to provide in the respective slide fit, radially between the outer component and the inner component, no gap or a gap having a small gap width which can in particular be smaller than a wall thickness of the outer component and/or of the inner component in the region of the slide fit and preferably smaller than 50% of this wall thickness.

5. The method of claim 1, wherein the calibrating process is carried out with the aid of a spacer sleeve which is arranged in the slide fit radially between the inner component and the outer component, wherein the spacer sleeve can be configured so as to be volatile, in particular for the temperatures occurring during operation of the exhaust collector.

6. The method of claim 1, wherein the calibrating process is carried out by means of a reshaping die having two half-shells.

7. The method of claim 6, wherein the calibration of the respective outer component is carried out in the same reshaping die at the same time in at least two slide fits.

8. The method of claim 6, wherein the calibration of the respective outer component is carried out in the same reshaping die at the same time in at least two inner shell bodies in each case at least one slide fit.

9. The method of claim 1, wherein the calibrating process is carried out in such a way as to provide in the respective slide fit, radially between the outer component and the inner component, no gap or a gap having a small gap width which can in particular be smaller than a wall thickness of the outer component and/or of the inner component in the region of the slide fit and preferably smaller than 20% of this wall thickness.

10. An air gap-insulated exhaust collector for an exhaust system of an internal combustion engine, in particular in a motor vehicle comprising:

an outer shell body defining a receiving space;

at least one inner shell body which is assembled from at least two gas-conducting components which are inserted into one another in the region of at least one slide fit, the at least one inner shell bod being positioned within the receiving space of the outer shell body forming a thermally insulating air gap between the gas-conducting components and the outer shell body;

wherein at least one slide fit of this type has been calibrated in that a reduction in cross section has been carried out at least on the outer component by reshaping;

wherein the at least one inner shell body includes at least two shell bodies positioned within the receiving space; and a partition positioned within the outer shell body separating the receiving space into two partial spaces, one of the at least two inner shell bodies is positioned in a corresponding one of the two partial spaces and the other one of the at least two inner shell bodies is positioned within the other one of the two partial spaces.

11. The exhaust collector of claim 10, wherein the respective components are inserted into one another without play in the respective slide fit.

12. The exhaust collector of claim 10, wherein a radial press fit, which allows thermally induced axial relative movements between the components which are mounted on one another via the slide fit, is present in the respective slide fit.

13. The exhaust collector of claim 10, wherein in the respective slide fit components, which are inserted into one another, abut one another without an axial gap or wherein there is provided radially between the outer component and the inner component a gap having a small gap width which can in particular be smaller than a wall thickness of the outer component and/or of the inner component in the region of the slide fit and preferably smaller than 50% of this wall thickness.

14. The exhaust collector of claim 10, wherein in the respective slide fit components, which are inserted into one another, abut one another without an axial gap or wherein there is provided radially between the outer component and the inner component a gap having a small gap width which can in particular be smaller than a wall thickness of the outer component and/or of the inner component in the region of the slide fit and preferably smaller than 20% of this wall thickness.

15. The exhaust collector of claim 10, wherein the at least one inner shell body includes at least two inlet pipes, wherein only the at least two inlet pipes of the at least one shell body protrude from the outer shell body.

16. The exhaust collector of claim 10, wherein the partition separates the two partial spaces from each other in a gas-tight manner impeding pressure compensation between the two partial spaces.

* * * * *

UNITED STATES PATENT AND TRADEMARK OFFICE

CERTIFICATE OF CORRECTION

PATENT NO. : 8,196,302 B2
APPLICATION NO. : 12/337122
DATED : June 12, 2012
INVENTOR(S) : Thomas Nording It is certified that error appears in the above-identified patent and that said Letters Patent is hereby corrected as shown below:

Claim 10,
Line 18, after "inner shell" delete the word "bod" and insert the word --body--

Signed and Sealed this
Twenty-fourth Day of July, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,196,302 B2
APPLICATION NO. : 12/337122
DATED : June 12, 2012
INVENTOR(S) : Thomas Nording It is certified that error appears in the above-identified patent and that said Letters Patent is hereby corrected as shown below:

Claim 10,
Column 8, Line 18, after "inner shell" delete the word "bod" and insert the word --body--

This certificate supersedes the Certificate of Correction issued July 24, 2012.

Signed and Sealed this
Twenty-eighth Day of August, 2012

David J. Kappos

David J. Kappos
*Director of the United States Patent and Trademark Office*